United States Patent [19]

Kristensson

[11] 4,004,836

[45] Jan. 25, 1977

[54] CHAIR WITH TILTABLE SPRING BIASED BACK-REST

[75] Inventor: Nils Lars Ove Kristensson, Stockholm, Sweden

[73] Assignee: Landstingens Inkopscentral Lic, Ekonomisk Forening, Solna, Sweden

[22] Filed: Oct. 15, 1975

[21] Appl. No.: 622,651

[30] Foreign Application Priority Data

Oct. 15, 1974 Sweden ..... 7412981

[52] U.S. Cl. ..... 297/354

[51] Int. Cl.[2] ..... A47C 3/00

[58] Field of Search ..... 297/429, 300, 304, 433, 297/354, 353, 355, 298, 301, 68, 91; 280/47.4

[56] References Cited

UNITED STATES PATENTS

| | | | |
|---|---|---|---|
| 3,024,067 | 3/1962 | Brandoli | 297/355 |
| 3,185,495 | 5/1965 | Pivacek | 297/DIG. 4 |
| 3,455,601 | 7/1969 | Lie | 297/301 |
| 3,528,532 | 9/1970 | Moskow | 297/355 X |
| 3,602,537 | 8/1971 | Kerstholt | 297/304 |

*Primary Examiner*—James T. McCall
*Attorney, Agent, or Firm*—Young & Thompson

[57] ABSTRACT

A wheel-chair having a spring biased tiltable back-rest. The resilient force exerted on the back-rest by the spring is continuously adjustable to suit the actual person sitting in the chair. Preferably, the spring is a gas spring which is combined with a device reducing the effect of the gas spring when the back-rest is in its upright position and adds to its effect when the back-rest is adjacent or in its horizontal position.

1 Claim, 4 Drawing Figures

CHAIR WITH TILTABLE SPRING BIASED BACK-REST

The present invention relates to chairs having a tiltable spring biased back-rest which may be locked in any desired position between an upright position and a horizontal position. The invention relates particularly to wheel-chairs to be used by invalids or weak or sick persons who normally have rather small physical capacity to overcome the forces necessary to lean backwards and urge the back-rest backwards towards its horizontal position against the action of predetermined forces from a spring member acting on the back-rest and biasing the same in all positions of the back-rest towards its upright position. The back-rest may be locked and released by any suitable known means.

A known chair of the kind under consideration is disclosed in U.S. Pat. No. 3,858,938 and is diagrammatically illustrated in FIGS. 1 and 2 of the enclosed drawings.

The back-rest frame of the known chair is pivotally mounted to tilt about a horizontal axis, and below this axis the back-rest frame is extended with a lever portion which is connected with one end of a spring member. This spring member is preferably a gas spring of well-known construction. The gas spring may be of the kind comprising a cylinder, a piston located in the cylinder and dividing an oil-filled chamber into two oil chambers. One oil chamber is located between the piston and one end wall of the cylinder, and the other oil chamber is located between the piston and a second piston which is freely movable in the cylinder and is actuated by a high pressure gas in the cylinder space between the second piston and the other end wall of the cylinder.

An axial valve rod extends outside one end wall of the cylinder, and when actuating the valve rod, a valve in the piston opens communication between the two oil chambers so that the gas pressure urges the piston and piston rod to move. Closing the valve results in that the piston and piston rod are locked in the cylinder. The pressure force exerted by the gas spring is substantially constant in all positions of the piston and its piston rod in relation to the action of a helical coil spring.

For a certain lever arm between the pivot axis of the back-rest and the attachment point of the gas spring to the lever arm, a corresponding force on the back-rest is required to tilt it backwards. However this force may be found to be too great for a weaker person, and therefore the gas spring must be replaced by a weaker gas spring in the known chairs. This involves a lot of time-consuming work and cost for an extra gas spring.

The present invention therefore has for its object to provide a simple device which enables a continuous adjustment of the effective length of the lever arm on which the gas spring is acting. Thus, no shifting of the gas spring will be required when there is a need for increasing or decreasing the force acting on the back-rest to suit the person using the chair.

Another object of the invention is to provide a device which diminishes certain drawbacks of using a gas spring and at the same time provides simple stop means for the back-rest to define its end position in its upright and horizontal position respectively.

These and other objects of the invention will be obtained from a device as defined in the following claims.

A preferred embodiment of the invention is illustrated in FIGS. 3 and 4 of the accompanying drawings and applied to a known chair of the type indicated in FIGS. 1 and 2.

Figure 1:
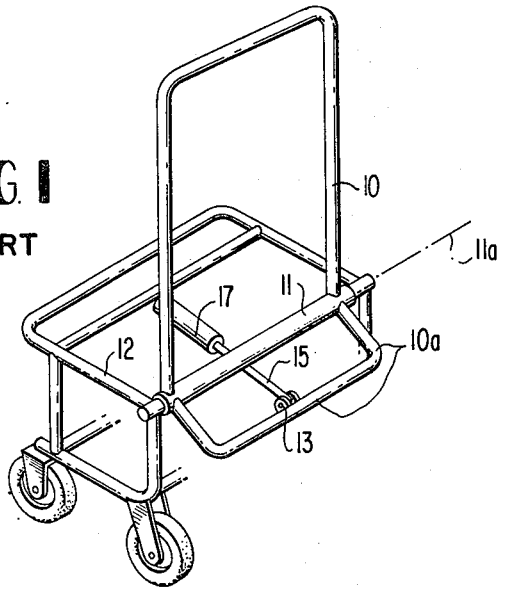
FIG. 1 PRIOR ART
FIG. 1 is a diagrammatic broken perspective view of the frame of a wheel-chair having a back-rest frame actuated by a gas spring.
Figure 2:
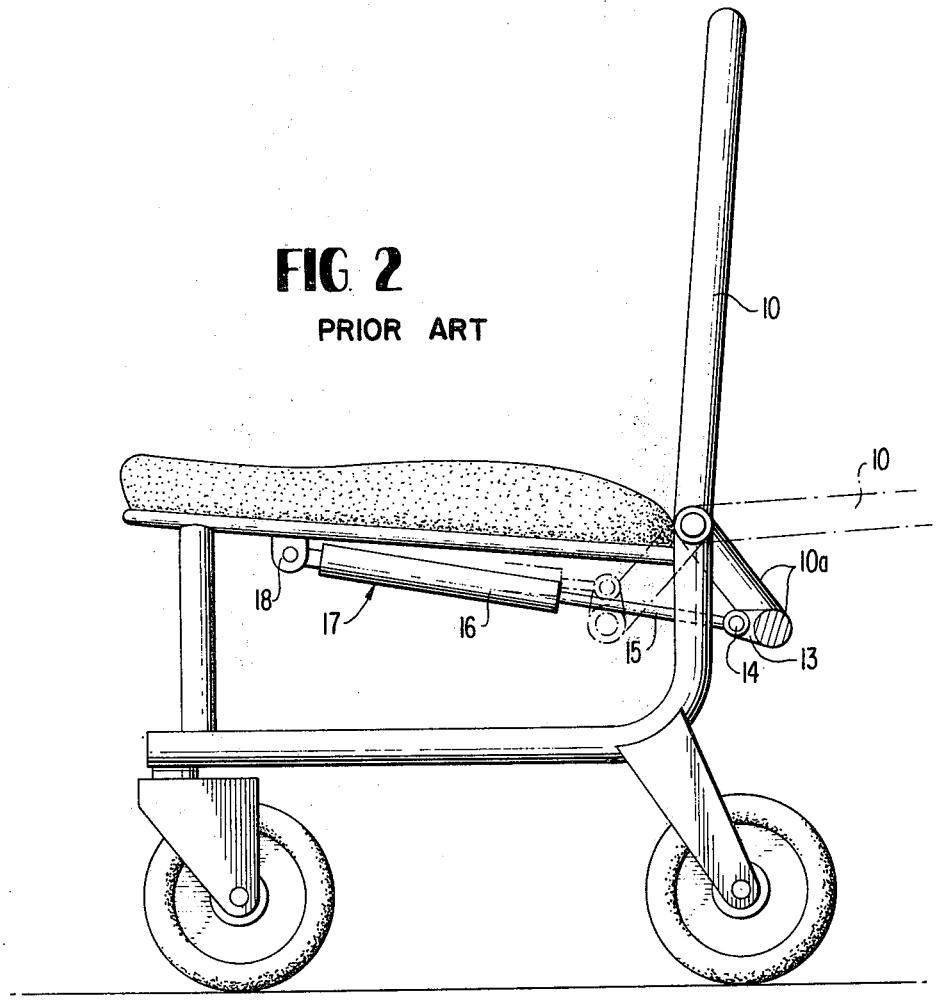
FIG. 2 PRIOR ART
FIG. 2 is a diagrammatic elevational view of the known chair in FIG. 1.

The back-rest frame 10 is fixed to a horizontal tube 11 pivotally mounted at its ends on the seat or chair frame 12 to tilt the back-rest about a horizontal axis 11*a*. To the tube 11 is secured the legs of a downwardly extending U-frame 10*a* having a pair of lugs 13 for securing the outer end 14 of a piston rod 15. The piston rod is secured at its other end to a piston (not shown) in the cylinder 16 of a gas spring 17 of the known type referred to above. The cylinder is at 18 attached to the seat frame 12.

Accordingly, the gas spring 17 will act on the back-rest frame 10 on a lever arm having an effective length equal to the radial distance from the horizontal axis 11*a* to the piston rod 15.

Figure 3:
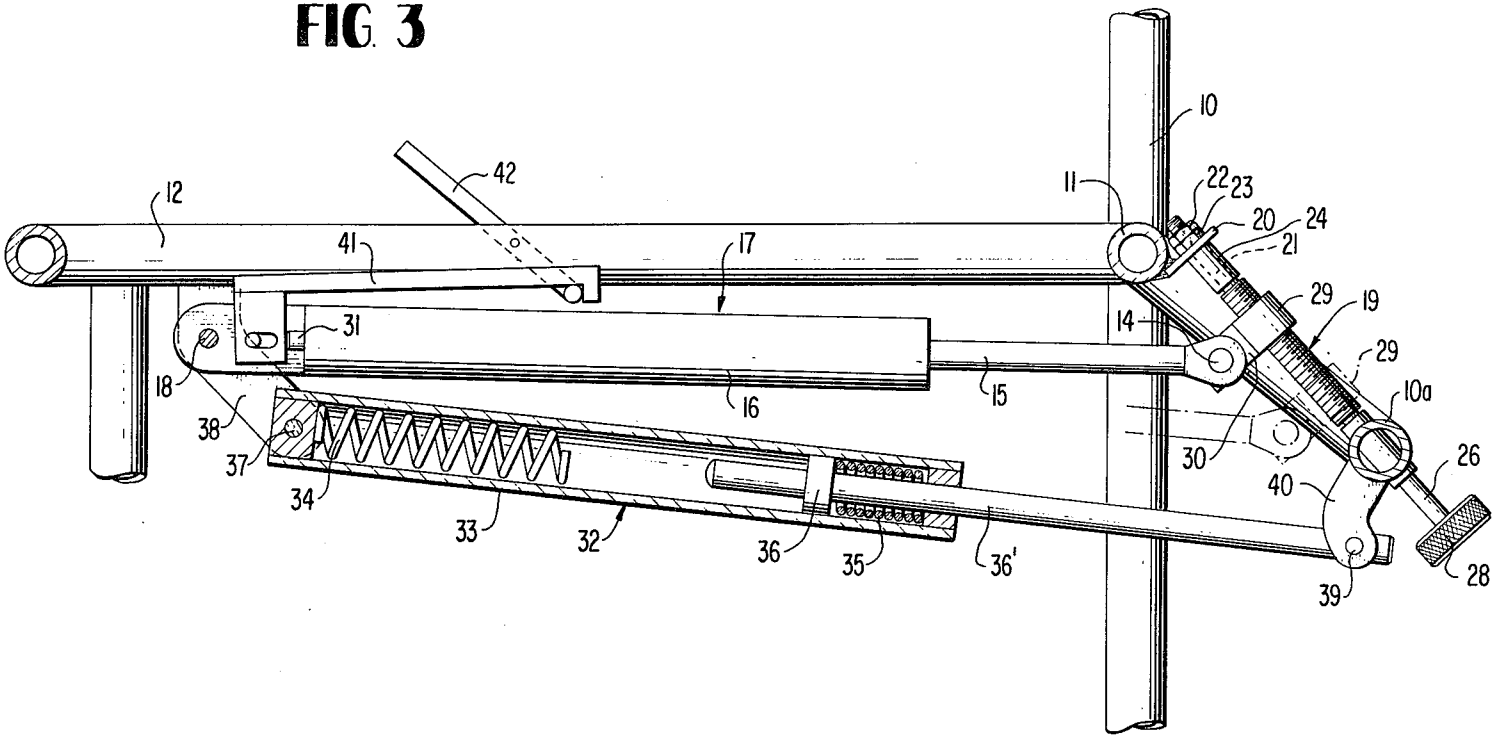
FIG. 3 is a detail view of the spring arrangement according to the invention applied to a known chair shown in FIGS. 1 and 2.
Figure 4:
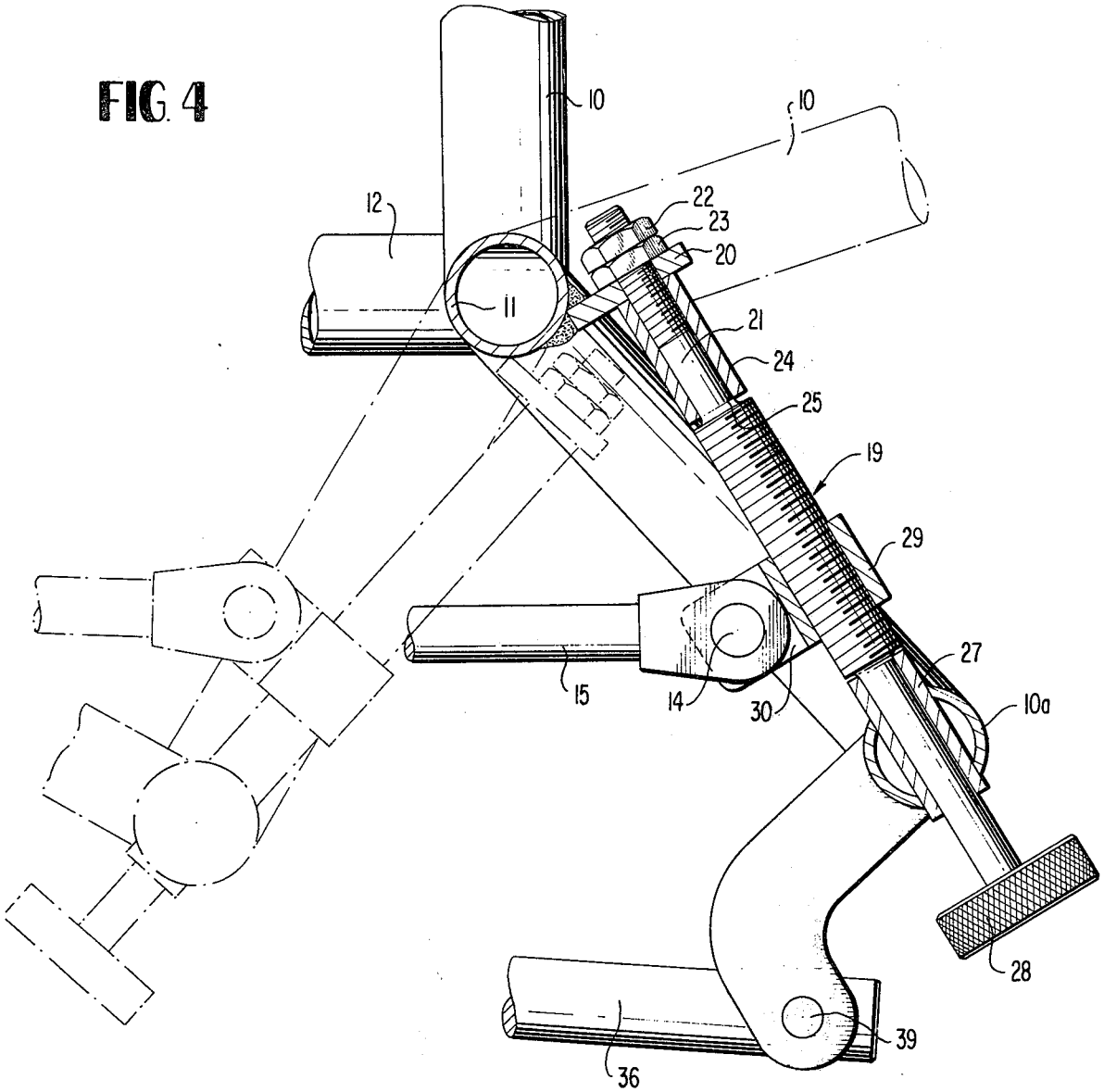
FIG. 4 is an enlarged detail view, partially in section, of the device in FIG. 3 in two angular positions.

As shown in FIGS. 3 and 4, the inventive device comprises an adjustment screw 19 extending between the tube 11 and the horizontal middle portion of the U-frame and being rotatably mounted in two bearings.

The upper bearing consists of a plate 20 secured to the tube 11 and having a boring for receiving the upper end 21 of the screw. Two locking nuts 22, 23 are secured on the end of the screw above the plate 20. A sleeve 24 is mounted on the end portion 21 between the plate 20 and a shoulder 25 on the screw, so that the screw is locked against axial movement.

The lower portion 26 of the screw is rotatably mounted in a sleeve 27 which extends through borings in the frame portion 10*a* and is secured to this frame portion. The lower end of the screw is provided with a control knob 28 for rotating the screw 19.

On the screw there is mounted a sleeve member 29 having internal threads cooperating with the threads of the screw. A pair of lugs 30 extend from the sleeve member 29 and are connected to the outer end 14 of the piston rod 15 of the gas spring 17.

A control rod 41 is movable by means of a control lever 42 to actuate the end 31 of the valve rod of the gas spring to release or lock the piston rod 15 in a manner known per se.

As shown in FIGS. 3 and 4, the device is further preferably provided with a power compensating device 32 which also serves as an abutment for the back-rest in its end positions. This device 32 comprises a cylinder 33 and two helical coil springs 34, 35 therein. A piston rod 36 extends into the cylinder and through the spring 35 and is at its inner end secured to a piston 36 located between the springs 34, 35.

The cylinder 33 is at one end pivotally mounted at 37 to the same bracket 38 which supports the gas spring 17 and is secured to the chair or seat frame 12, whereas the outer end 39 of the piston rod is pivotally mounted in lugs 40 secured to the frame portion 10a.

In the position shown in FIG. 3 for the spring 35, the back-rest 10 is in its upright position and the sleeve 29 is in its lower end position shown by dotted lines. The spring 35 is almost fully compressed so that the back-rest cannot be tilted further forwards. When releasing the gas spring, it will exert its full power of the back-rest. However, this is to be desired degree reduced by the counteraction of the spring 35, which means that the start of tilting the back-rest backwards can be effected by the person or patient sitting in the chair with less effort than would be required without the assistance of the compensating device 32.

However, the resilient resistance of the gas spring 17 may still be too great, but this may be easily overcome by rotating the knob 28 so that the sleeve 29 is axially displaced towards the tilting axis 11*a* and the tube 11 respectively. This will reduce the effective length of the lever arm between the gas spring piston rod 15 and the tilting axis 11*a*.

The possibility of an easy and quick adjustment of the spring force acting on the back-rest is a great advantage, particularly with respect to the fact that it can be done without the aid of tools and may be carried out by any person without technical knowledge.

The physical condition of a person may vary from one day to another, and if a weaker or stronger spring action would be desired some day, the proper adjustment can be carried out quickly and without any difficulties.

In a middle position of the back-rest where the weight of the body is to a greater degree acting on the back-rest, the piston 36 is substantially free from the influence of the two springs 34, 35 so that practically the full force of the gas spring 17 is acting on the back-rest.

As the back-rest is coming nearer its substantially horizontal position, the second spring 34 is increasingly compressed, which means that this spring will assist the gas spring in this position of the back-rest. Accordingly, when a person intends to rise from a horizontal position to an upright position, the spring 34 will assist the movement when starting from the horizontal position which is a great advantage for sick or weak persons.

When the back-rest is in its horizontal position, the spring 34 is fully compressed and functions as a stop member to prevent further tilting downwards of the back-rest.

The conventional gas spring 17 in combination with the continuously adjustable attachment sleeve 29 forms a low cost device for effecting the desired result which may be further improved by using the simple and cheap combined compensating and stop device 32.

What I claim is:

1. A chair having a tiltable back-rest frame rotatably mounted on the chair frame about a horizontal axis and being tiltable backwards against the action of a pressure spring member mounted between the frame of the chair and a lever arm rigidly connected with the back-rest and extending downwardly relative to said horizontal axis, the lever arm comprising an adjustment screw rotatably mounted in an extended frame member secured to the back-rest and located below said horizontal axis, a threaded sleeve mounted on the adjustment screw and connected with the spring member, the adjustment screw having a knob to enable rotation of the adjustment screw thereby to effect continuous axial displacement of the threaded sleeve along the screw, the spring member being a gas spring comprising a cylinder and a piston rod adapted to be locked in any desired position of the piston rod relative to the cylinder, a further cylinder and piston therein with a piston rod including two helical compression coil springs located in the cylinder on opposite sides of the piston, the further cylinder and piston rod extending between the chair frame and the extended frame member so that one of the helical springs will be substantially fully compressed when the backrest is in its upright position to form a stop member and to counteract the gas spring, whereas the other helical spring is substantially fully compressed when the back-rest is in its substantially horizontal position to form a stop member and to assist the gas spring when raising the back-rest.

* * * * *